US010928034B2

(12) United States Patent
Liu et al.

(10) Patent No.: US 10,928,034 B2
(45) Date of Patent: Feb. 23, 2021

(54) LIGHT DISTRIBUTION ELEMENT, LIGHT SOURCE MODULE AND LIGHTING DEVICE

(71) Applicant: OPPLE LIGHTING CO., LTD., Shanghai (CN)

(72) Inventors: Chaobo Liu, Shanghai (CN); Hongbo Wang, Shanghai (CN); Qingjun Wei, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/697,166

(22) Filed: Nov. 26, 2019

(65) Prior Publication Data

US 2020/0096174 A1 Mar. 26, 2020

Related U.S. Application Data

(63) Continuation of application No. PCT/CN2018/088230, filed on May 24, 2018.

(30) Foreign Application Priority Data

May 27, 2017 (CN) ..... 201710395774.2
May 27, 2017 (CN) ..... 201710396648.9
(Continued)

(51) Int. Cl.
*F21V 5/04* (2006.01)
*F21S 8/08* (2006.01)
(Continued)

(52) U.S. Cl.
CPC ..... *F21V 5/048* (2013.01); *F21S 8/086* (2013.01); *F21V 5/007* (2013.01); *F21W 2131/103* (2013.01)

(58) Field of Classification Search
CPC .. F21V 5/048; F21V 5/007; F21V 5/04; F21S 8/086; F21W 2131/103; F21Y 2105/16; F21Y 2115/10
See application file for complete search history.

(56) References Cited

U.S. PATENT DOCUMENTS

D859,731 S * 9/2019 Wang ..... F21S 8/033 D26/120
2009/0225551 A1* 9/2009 Chang ..... F21V 5/08 362/311.06
(Continued)

FOREIGN PATENT DOCUMENTS

CN 202165991 U 3/2012
CN 203628520 U 6/2014
(Continued)

OTHER PUBLICATIONS

CN203628520U,Jun. 2014, machine translation (Year: 2014).*
(Continued)

*Primary Examiner* — Tracie Y Green
(74) *Attorney, Agent, or Firm* — Arch & Lake LLP

(57) ABSTRACT

The present disclosure provides a light distribution element and a light source module. The light distribution element includes: a light incident surface which is in the shape of a smooth inward concave curved surface and forms an accommodation cavity for accommodating a light emitting unit; and a light emitting surface which is in the shape of a smooth outward convex curved surface and is provided opposite to the light incident surface. There is a difference between the thickness of the light incident surface and the thickness of the light emitting surface, thus in the light spot formed by the light emitted from the light emitting surface where the thickness is relatively large, the color tolerance between a yellow spot and white light is less than a preset color difference.

19 Claims, 8 Drawing Sheets

(30) Foreign Application Priority Data

May 27, 2017 (CN) ..... 201720614456.6
May 27, 2017 (CN) ..... 201720614705.1

(51) Int. Cl.
*F21V 5/00* (2018.01)
*F21W 131/103* (2006.01)

(56) References Cited

U.S. PATENT DOCUMENTS

2012/0307495 A1* 12/2012 Shih ..... G02B 19/0066 362/237
2013/0155673 A1* 6/2013 Wang ..... F21V 17/02 362/235
2015/0078011 A1* 3/2015 Sy ..... F21V 7/048 362/327
2016/0187555 A1* 6/2016 Yuan ..... G02B 6/002 362/343
2017/0030548 A1 2/2017 Hirai
2017/0031085 A1* 2/2017 Lim ..... G02B 6/32
2020/0088398 A1* 3/2020 Wang ..... F21V 25/00
2020/0224852 A1* 7/2020 Liu ..... F21V 5/04

FOREIGN PATENT DOCUMENTS

CN 203784827 U 8/2014
CN 104344335 A 2/2015
CN 105276522 A 1/2016
CN 107023786 A 8/2017
CN 107023787 A 8/2017
CN 207378677 U 5/2018

OTHER PUBLICATIONS

CN202165991U Mar. 2012, machine translation (Year: 2012).*
International Search Report (including English translation) and Written Opinion issued in PCT/CN2018/088230, dated Aug. 28, 2018, 12 pages.

* cited by examiner

LIGHT DISTRIBUTION ELEMENT, LIGHT SOURCE MODULE AND LIGHTING DEVICE

CROSS-REFERENCE TO RELATED APPLICATIONS

This application is based upon and claims the priority of PCT patent application No. PCT/CN2018/088230 filed on May 24, 2018 which claims the priority of Chinese Patent Application No. 201710395774.2 filed on May 27, 2017, Chinese Patent Application No. 201710396648.9 filed on May 27, 2017, Chinese Patent Application No. 201720614456.6 filed on May 27, 2017, and Chinese Patent Application No. 201720614705.1 filed on May 27, 2017, the entire content of all of which is hereby incorporated by reference herein for all purposes.

TECHNICAL FIELD

The present disclosure relates to a field of lighting technology, especially to a light distribution element, a light source module and a lighting device.

BACKGROUND

A light device generally may include a light source module, a power source module for providing power for the light source module, and a substrate for supporting the light source module and the power source module.

SUMMARY

The present disclosure provides a light distribution element and a light source module.

According to a first aspect, the present disclosure provide a light distribution element. The light distribution element may include a light incident surface, which is in a shape of a smooth inward concave curved surface and forms an accommodation cavity for accommodating a light emitting unit; and a light emitting surface, which is in a shape of a smooth outward convex curved surface and is opposite to the light incident surface. A thickness difference may exist and may be between the light incident surface and the light emitting surface, and in a light spot formed by light emitted from the light emitting surface where the thickness difference is relatively large, a color tolerance between a yellow spot and white light may be less than a preset color difference.

According to a second aspect, the present disclosure provides a light distribution element. The light distribution element may include a light incident surface, which is in a shape of a smooth inward concave curved surface and forms an accommodation cavity for accommodating a light emitting unit, comprises a center point; and a light emitting surface, which is in a shape of a smooth outward convex curved surface and is opposite to the light incident surface, comprises a center point. The center point of the light emitting surface may be staggered with the center point of the light incident surface in a vertical direction, and the center point of the light emitting surface may be aligned with the light emitting unit located in the accommodation cavity in the vertical direction.

According to a third aspect, the present disclosure provides a light source module. The light source module may include a substrate, a light emitting unit provided on the substrate, and a light distribution element.

The light distribution element may include a light incident surface, which is in a shape of a smooth inward concave curved surface and forms an accommodation cavity for accommodating a light emitting unit; and a light emitting surface, which is in a shape of a smooth outward convex curved surface and is opposite to the light incident surface. A thickness difference may exist and may be between the light incident surface and the light emitting surface, and in a light spot formed by light emitted from the light emitting surface where the thickness difference is relatively large, a color tolerance between a yellow spot and white light may be less than a preset color difference.

The light distribution element may be mounted to the substrate and may cover the light emitting unit, and the light emitting unit may be located in the accommodation cavity of the light distribution element and may be aligned with a center point of the light emitting surface in a vertical direction.

It is to be understood that both the foregoing general description and the following detailed description are exemplary and explanatory only and are not restrictive of the present disclosure.

BRIEF DESCRIPTION OF THE DRAWINGS

To illustrate technical solutions according to the examples of the present disclosure or in the prior art more clearly, accompanying drawings required for describing the examples or the prior art are introduced below briefly. Apparently, the accompanying drawings in the following descriptions are merely some of the examples of the present disclosure, and persons of ordinary skill in the art may obtain other drawings according to these accompanying drawings without making creative efforts. In the drawings.

DETAILED DESCRIPTION

In order to make persons skilled in the art understand technical solutions in the present disclosure better, the technical solutions in the examples of the present disclosure are described below with reference to accompanying drawings in the examples of the present disclosure. The described examples are merely a part of, rather than all of, the examples of the present disclosure. Based on these examples of the present disclosure, all other examples that can occur to those ordinarily skilled in the art without any inventive effort shall fall into the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The light source module may include a light emitting unit and a light distribution element covering in a light emitting direction of the light emitting unit, and the light distribution element can adjust a direction of light emitted by the light emitting unit to realize illumination on a target area.

Sometimes, there is a technology bottleneck in the light emitting unit, light located in an edge of a light emitting angle may turn yellow, thus, causing a yellow light spot to occur in an area illuminated by the lighting device. The yellow light spot may badly decrease an illumination effect of the lighting device. The present disclosure addresses this issue.

Figure 1:
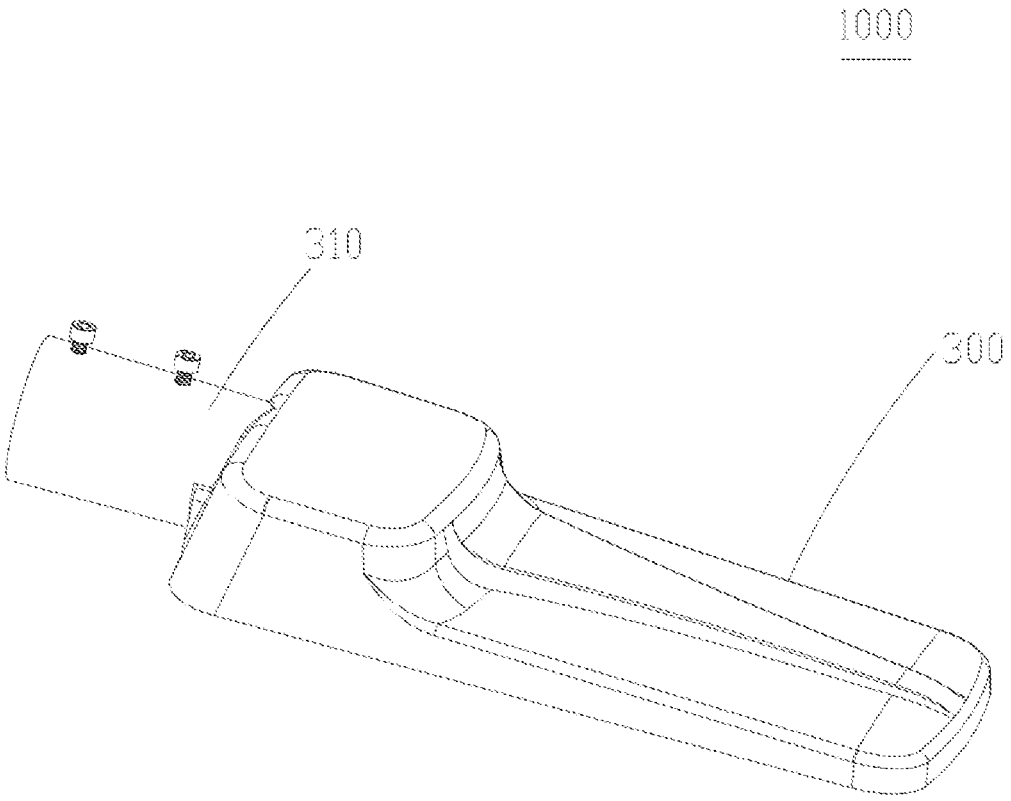
FIG. 1 is a perspective view of a lighting device according to one example of the present disclosure.
Figure 2:
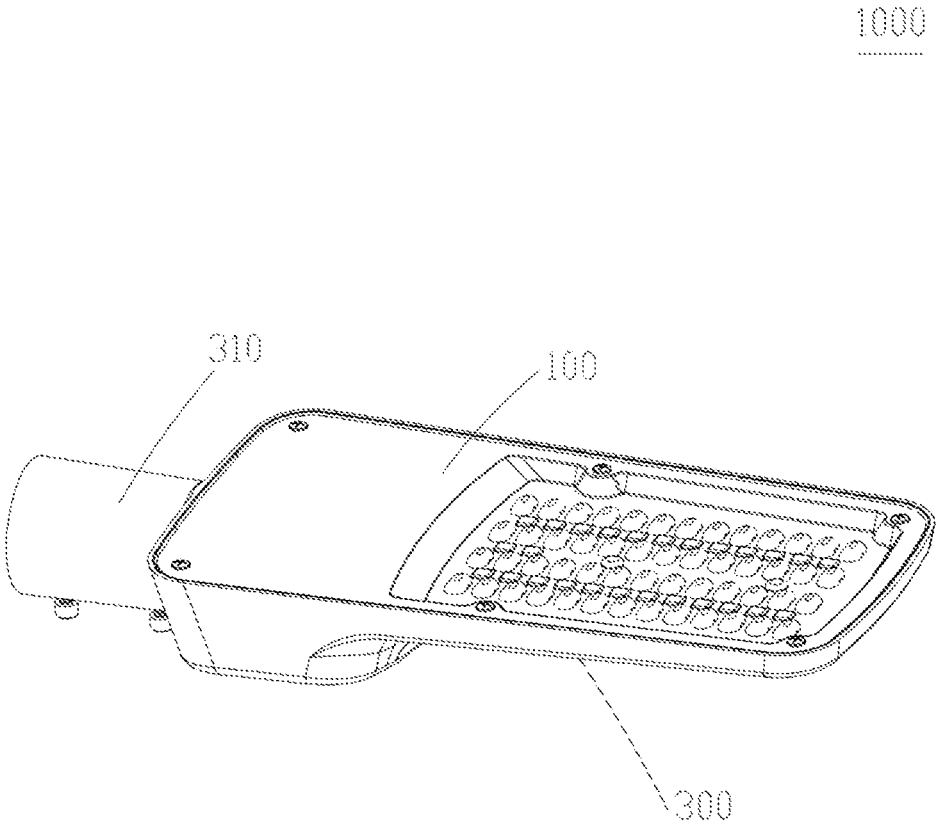
FIG. 2 is a perspective view of a lighting device at another angle according to one example of the present disclosure.

As shown in FIGS. 1 and 2, the lighting device 1000 includes a light source module 100 and a power source module 200 (referring to FIG. 3) which are electrically connected with each other. The power source module 200 may obtain power from commercial power or an external battery, and then transport the power to the light source module 100; the light source module 100 emits light rays after obtaining the power to illuminate a preset area.

In practical applications, both the light source module 100 and the power source module 200 may be located on a housing 300, the lighting device 1000 may be a street lamp or another type of a residential or outdoor lamp, and the shape and material of the housing 300 may be determined based on the type and application environment of the lighting device 1000. For example, in a case where a street lamp is used as the lighting device 1000, the housing 300 may also be set according to the conventional shape of the street lamp.

In the examples of the present disclosure, the lighting device further includes a vertical supporting arm (not shown), mounted to a base board, a road surface, or the like. In a case where a street lamp is used as the lighting device 1000, this vertical supporting arm is a lamp post. The housing 300 includes a mounting tail end 310 for connecting the vertical supporting arm (not shown). The mounting tail end 310 may be in a shape of hollow tube, and commercial cables may be electrically connected with the light source module 100 and the power source module 200 through the vertical supporting arm and an interior of the mounting tail end 310. In practical use, the mounting tail end 310 may be connected with the vertical supporting arm using screws or the like.

In practical applications, a number of the light source module 100 may be at least one; the power source module 200 may include a current regulation unit, an overcurrent protection unit, or the like, and the power source module 200 may be in patch or plug-in type, which is not repeated herein.

Figure 3:
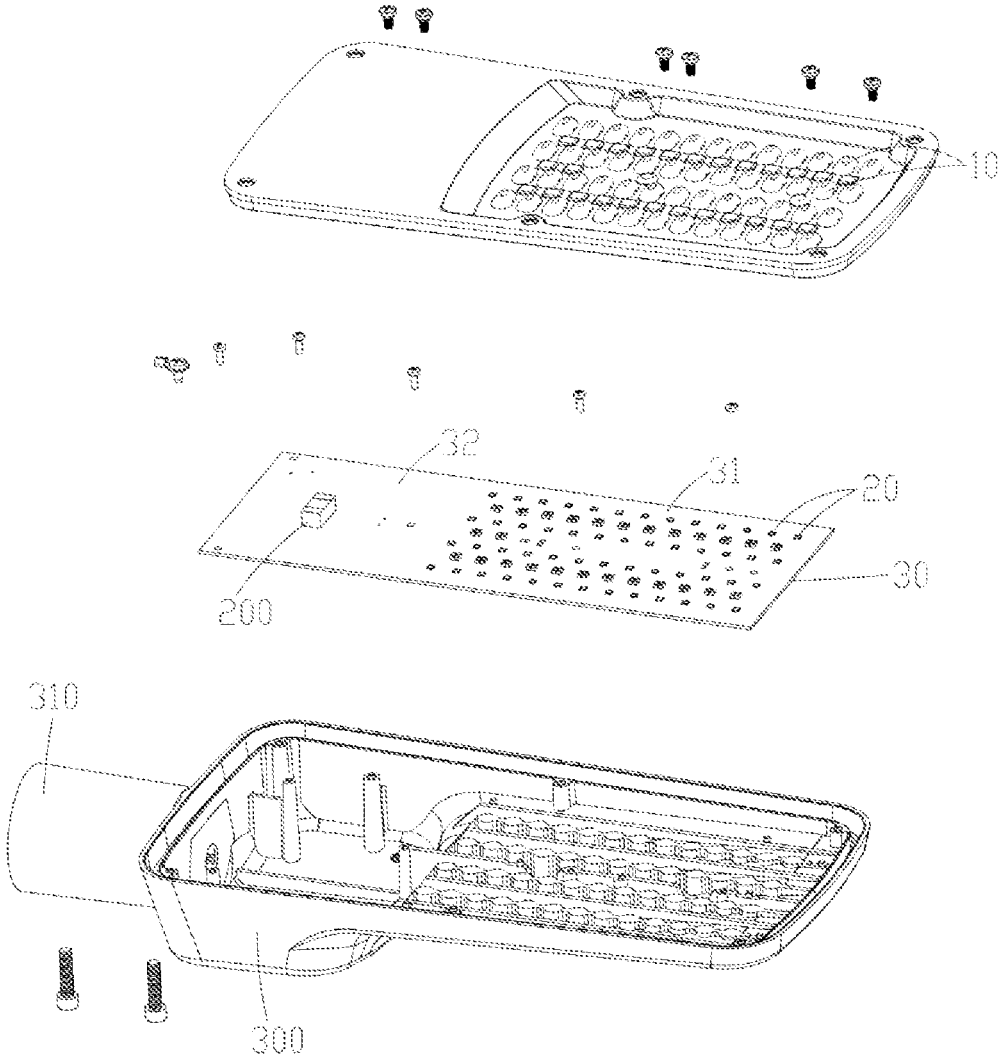
FIG. 3 is an exploded view of a lighting device according to one example of the present disclosure.

Referring to FIG. 3, the light source module 100 includes light distribution elements 10, light emitting units 20 and a substrate 30. The substrate 30 is mounted into the housing 300, a plurality of light emitting units 20 are arranged on the substrate 30 in an array, a plurality of light distribution elements 10 are also arranged on the substrate 30 in an array, and each of the light distribution elements 10 is covered on at least one light emitting unit 20. Similarly, the light distribution elements 10 are connected with one another by means of light transmitting materials. In practical applications, the satisfactory number of light distribution elements 10 with desired layouts may be formed in one piece by injection moulding.

In the examples of the present disclosure, the power source module 200 is also located on the substrate 30 and is electrically connected with the light emitting unit 20 through an electrical element in the substrate 30. In practical applications, the substrate 30 includes a lengthwise direction, and a light source accommodation region 31 and a mounting region 32 which are sequentially arranged along the lengthwise direction, and the light emitting units 20 and the light distribution elements 10 are all located in the light source accommodation region 31, and the power supply module 200 is located in the mounting region 32.

Figure 4:
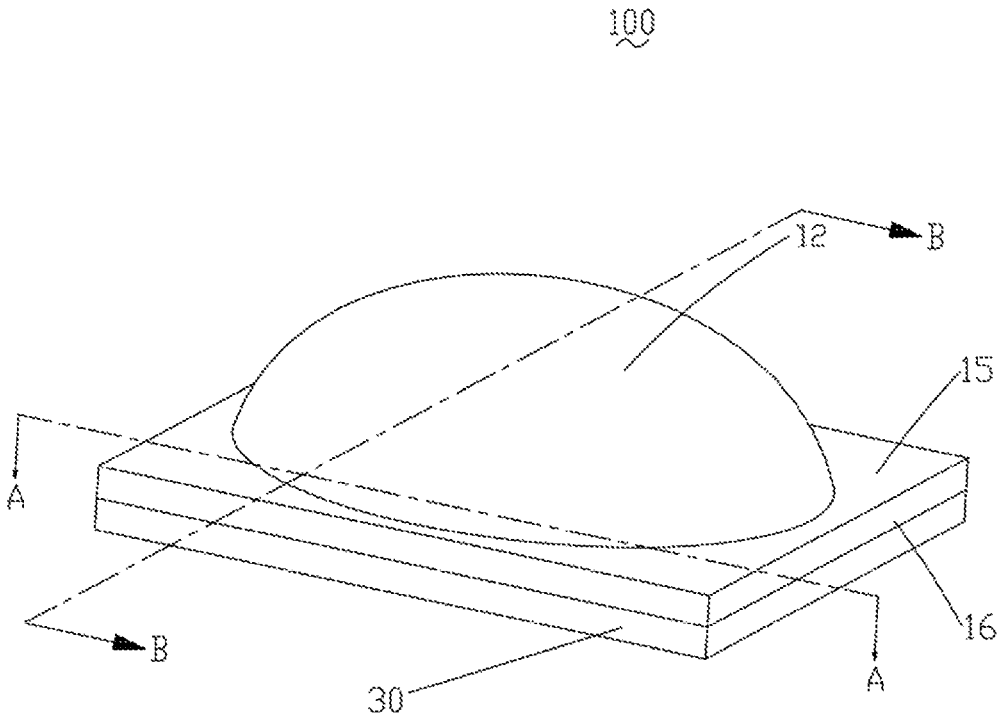
FIG. 4 is schematic local diagram of a light source module according to one example of the present disclosure, the light source module in this situation including an optical element, a light emitting unit and a part of a substrate.
Figure 5:
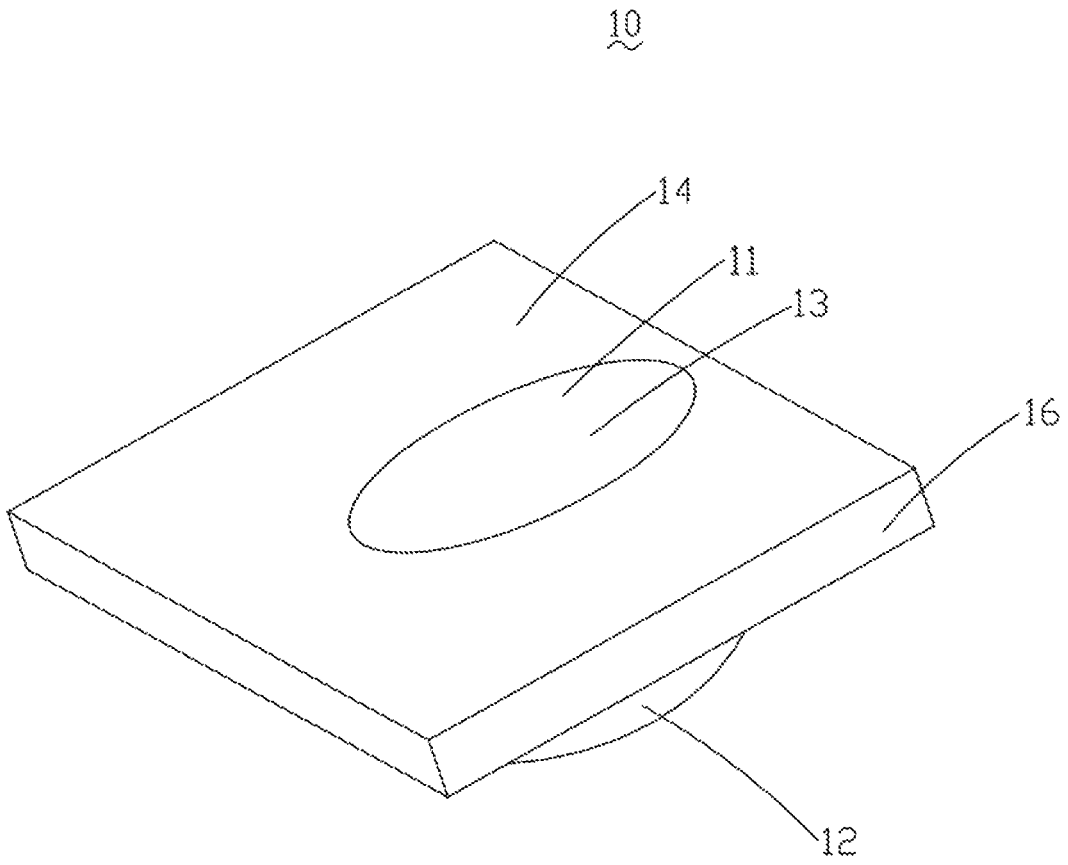
FIG. 5 is a perspective view of the optical element in the light source module shown in FIG. 4.

Referring to FIGS. 4 and 5, in the light source module 100, the light distribution element 10 is mainly configured for regulating angle and direction of the light ray emitted from the light emitting unit 20. The light distribution element 10 may be made of a transparent material, such as polycarbonate PC, polymethyl methacrylate PMMA, or the like, and the size of the light distribution element 10 may also be adjusted adaptively according to an application scenario of the light source module 100 and lighting demands, which are not repeated herein.

The light distribution element 10 includes a light incident surface 11 and a light emitting surface 12 which are arranged opposite to each other. Both the light incident surface 11 and the light emitting surface 12 are in a shape of a smooth curved surface. That is, no obvious deformation occurs on the light incident surface 11 and the light emitting surface 12, and the deformation herein may refer to a protrusion, a depression, or their combination. The "obvious deformation" herein may refer to the deformation which may be recognized by human eyes or touched and perceived by fingers, or the limited lighting effect caused by the great influence of the deformation on the light ray adjustment of the light distribution element 10, without generally referring to all types of deformations. Therefore, in a case where the deformation on the light incident surface 11 or the light emitting surface 12 does not affect the light distribution of the light distribution element 10, the light incident surface 11 or the light emitting surface 12 may be considered as smooth; in a case where the deformation on the light incident surface 11 or the light emitting surface 12 cannot be recognized by human eyes or touched and perceived by fingers, the light incident surface 11 or the light emitting surface 12 may also be considered as smooth.

In practical applications, whether the above-mentioned deformation affects the light distribution of the light distribution element 10 may be judged by physically or artificially comparing the light distribution element with such a deformation, with the light distribution element without such a deformation (an optimal light distribution element provided by the inventor), so as to determine whether a difference in light distribution effect therebetween is within an acceptable range. The "acceptable range" herein may be set by inventors based on the lighting scenario or user demands, without generally referring to a general standard suitable for any user or scenario. Certainly, in the case of the deformation which may be touched and perceived by fingers of a related testing personnel or seen by human eyes, this light incident surface 11 or the light emitting surface 12 is considered as not smooth.

In the present example, the light incident surface 11 is in a shape of an inward concave curved surface and forms an accommodation cavity 13 for accommodating the light emitting unit 20, the light ray emitted from the light emitting unit 20 arrives at the light incident surface 11, and then is emitted out through the light emitting surface 12. The light emitting surface 12 is in a shape of an outward convex curved surface and protrudes in a direction the same as the direction in which the light incident surface 11 is concaved.

In practical applications, the light incident surface 11 and the light emitting surface 12 are both in a shape of a partial spherical surface substantially. The "shape of partial spherical surface" herein may be obtained by cutting a whole spherical surface, or may be formed by splicing several partial spherical surfaces, so long as the light incident surface 11 and the light emitting surface 12 are guaranteed to be smooth.

The light distribution element 10 may further include a bottom surface 14 located at a peripheral side of the light incident surface 11. The bottom surface 14 is flat and is configured for being directed attached to the substrate 30, so as to cover the light distribution element 10 on the light emitting unit 20. Even if an overlarge distance exists between the light distribution element 10 and the substrate 30 due to an assembly problem, the light rays can be only emitted from the light distribution element 10, which avoids negative optical effects, such as crescent bright spots. The light distribution element 10 further includes a top surface 15 located at a peripheral side of the light emitting surface 12, the top surface 15 is arranged parallel with the bottom surface 14, and is connected with the bottom surface 14 by means of a side surface 16 to form a square mounting portion.

Certainly, in a case where the light source module 100 includes a plurality of light distribution elements 10, these light distribution elements may be connected with the substrate 30 using screws or in a snap-joint manner, or with the housing 300, which is well-known by persons skilled in the art, and is not repeated herein.

Figure 6:
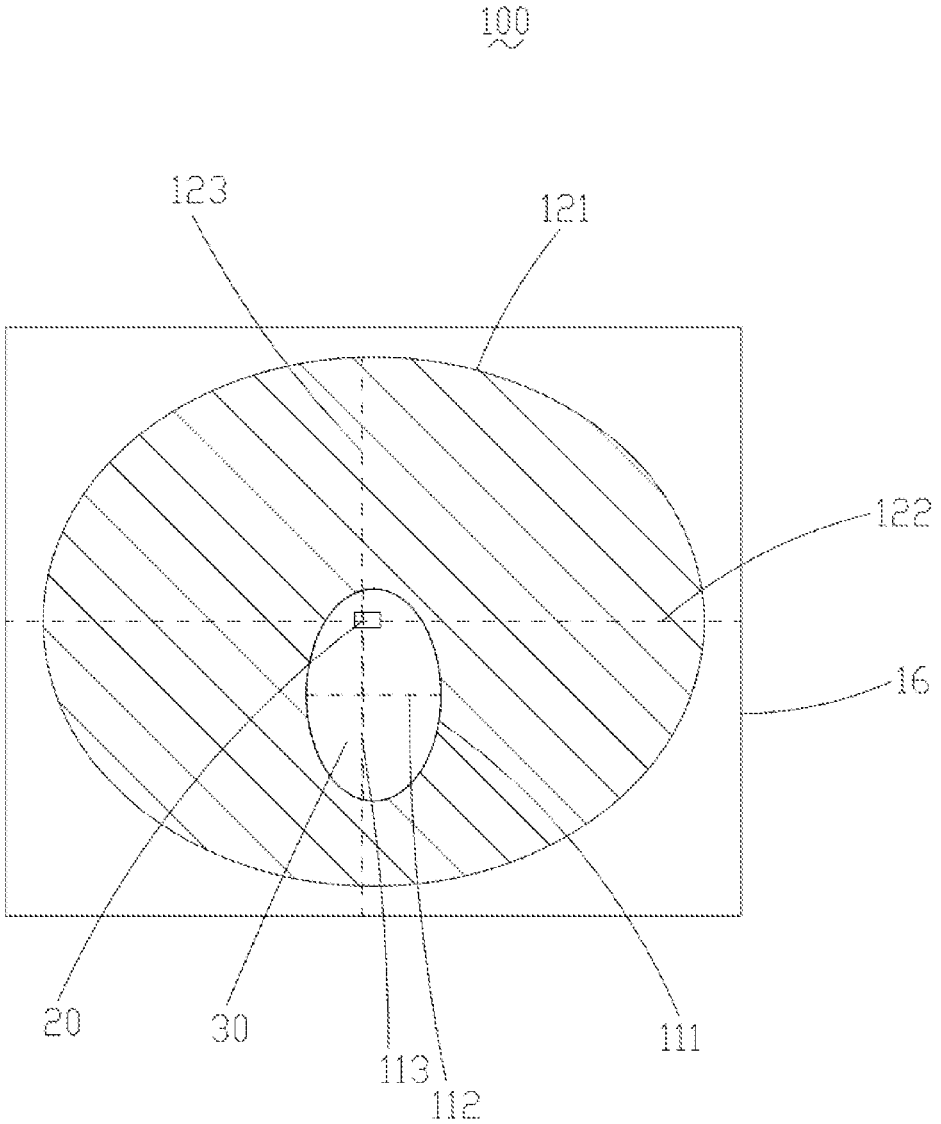
FIG. 6 is a sectional view of the light source module shown in FIG. 4 in A-A direction.

FIG. 6 is a sectional view of a part of the light source module shown in FIG. 4 in A-A direction. The plane where the A-A direction is located may be understood as a horizontal plane, and in this situation, the light source module 100 is also arranged on the horizontal plane. The shapes of the light incident surface 11 and the light emitting surface 12 on the horizontal plane will be described in detail below with reference to the sectional view of FIG. 6.

The light incident surface 11 has a light incident edge 111, the light emitting surface 12 has a light emitting edge 121, and the light incident edge 111 and the light emitting edge 121 indicate the substantial shapes of the light incident surface 11 and the light emitting surface 12 respectively. Taking the light incident surface 11 as an example, a profile of the light incident edge 111 reflects a projection of the light incident surface 11 on the horizontal plane. When the light incident edge 111 is circular, the light incident surface 11 is a partial spherical surface; when the light incident edge 111 is elliptical, the light incident surface 11 is a partial ellipsoidal surface.

In the present example, a point distance between a portion of the light incident edge 111 and a portion of the light emitting edge 121 is less than a preset point distance threshold value which may be set in advance, for example, as 1 millimeter or other values. In practical use, the preset point distance threshold value may be set very small, such that the light incident edge 111 and the light emitting edge 121 are overlapped basically or exactly at some points.

Subsequently, the light incident surface 11 and the light emitting surface 12 both include a cross cutting line and a rip cutting line for dividing into four quadrants, wherein the cross cutting line is a cutting line in the middle along a crosswise direction of the light incident surface 11 or the light emitting surface 12, and the rip cutting line is a cutting line in the middle along a lengthwise direction of the light incident surface 11 or the light emitting surface 12. It should be noted that the cross and rip cutting lines are virtual lines for the subsequent detailed description about the technical solutions, without limiting the shapes of the light incident surface 11 and the light emitting surface 12.

In the present example, the cut light incident surface 11 and the light emitting surface 12 are symmetric in the four quadrants. By taking the light incident surface 11 which is symmetric in the four quadrants as an example, it is indicated that the light incident surface 11 is divided into four parts after cut in crosswise and lengthwise directions, and any two of the four parts are symmetric axially or centrally. For example, the parts located in the first and second quadrants are symmetric axially, and the parts located in the first and third quadrants are symmetric centrally.

It should be noted that the "symmetric in the four quadrants" herein does not refer in particular to the absolute symmetry mathematically, but may include approximate symmetry. Still taking the light incident surface 11 as an example, at least two of the four parts are symmetric approximately, for example, the parts in the first and second quadrants are symmetric axially approximately, or the parts in the first and third quadrants are symmetric centrally approximately, and even the parts in the first and second quadrants are symmetric axially approximately, and the parts in the first and third quadrants are symmetric centrally approximately.

In order to describe the horizontal shapes of the light incident surface 11 and the light emitting surface 12 conveniently, the projections of the cross and rip cutting lines, for dividing the light incident surface 11 into four quadrants, on the horizontal plane are set to be the light incident cross cutting line 112 and the light incident rip cutting line 113, and the projections of the cross and rip cutting lines, for dividing the light emitting surface 12 into four quadrants, on the horizontal plane are set to be the light emitting cross cutting line 122 and the light emitting rip cutting line 123.

In the present example, a length of the light incident cross cutting line 112 is less than that of the light incident rip cutting line 13, i.e., the projection of the light incident surface 11 on the horizontal plane is preferably in a shape of oval or an approximate oval. In the meantime, a length of the light emitting cross cutting line 122 is greater than that of the light emitting rip cutting line 123, i.e., the projection of the light emitting surface 12 on the horizontal plane is preferably in a shape of oval or an approximate oval.

Preferably, a ratio between the light incident rip cutting line 113 and the light incident cross cutting line 112 is greater than a ratio between the light emitting rip cutting line 123 and the light emitting cross cutting line 122, such that the light incident surface 11 is longer and narrower than the light emitting surface 12.

The light incident cross cutting line 112 is parallel with the light emitting cross cutting line 122. It should be noted that the parallelism herein does not refer to the absolute parallelism in the sense of data, and may also include approximate parallelism, which is not repeated herein. Moreover, the distance between the light incident rip cutting line 113 and the light emitting rip cutting line 123 is less than a preset line distance threshold value which may be set in advance, for example, as 1 millimeter or other values. In practical use, the preset point distance threshold value may be set to be very small, such that the light incident rip cutting line 113 and the light emitting rip cutting line 123 are overlapped basically or exactly.

The light incident surface 11 and the light emitting surface 12 both have center points. The center point is a middle point or a highest point of the surface. By taking the light incident surface 11 and the light emitting surface 12 which are both symmetric in the four quadrants as examples, the projection of the center point of the light incident surface 11 on the horizontal plane is an intersection point between the light incident rip cutting line 113 and the light incident cross cutting line 112, and the projection of the center point of the light emitting surface 12 on the horizontal plane is an intersection point between the light emitting rip cutting line 123 and the light emitting cross cutting line 122. In the present example, the center point of the light incident surface 11 and the center point of the light emitting surface 12 are staggered with each other in a vertical direction; that is, a connection line therebetween is not along the vertical direction.

In the examples of the present disclosure, along the cross cutting line of the light emitting surface 12, a thickness between the light incident surface 11 and the light emitting surface 12 is characterized in that the thickness is minimum between the center point of the light emitting surface 12 and the light incident surface 11, and from the center point to two sides of the light emitting surface, the thickness between the light emitting surface and the light incident surface increases symmetrically, i.e., the center point of the light emitting surface 12 is a boundary point, and thicknesses at the two sides progressively increase at the same amplitude.

Figure 7:
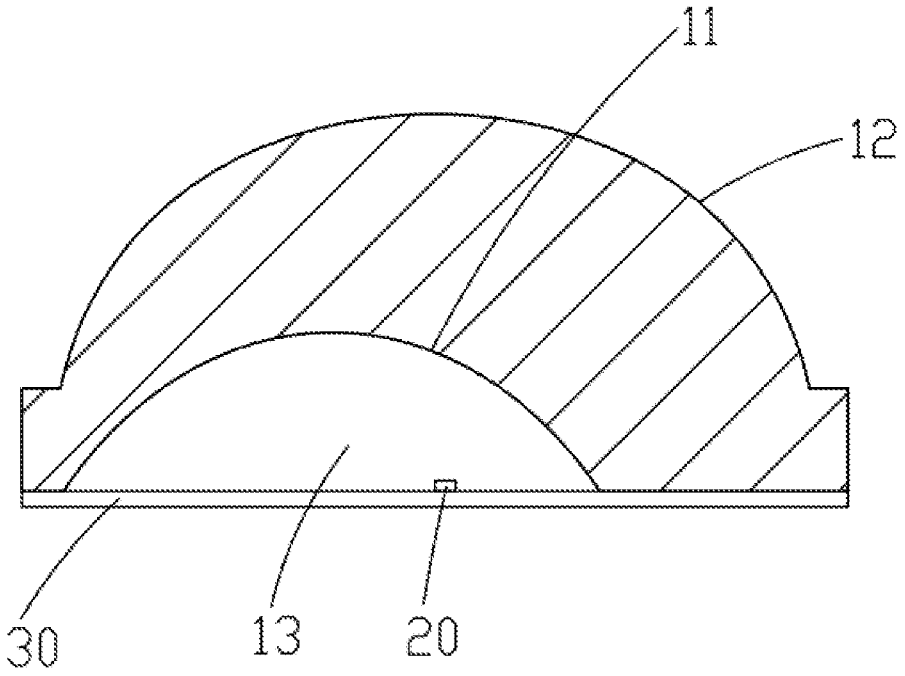
FIG. 7 is a sectional view of the light source module shown in FIG. 4 in B-B direction.

FIG. 7 is a sectional view of a part of the light source module 100 shown in FIG. 4 in B-B direction. The plane where the B-B direction is located may be understood as a vertical surface perpendicular to the A-A direction, at which situation, the light distribution element 10 is still arranged on the horizontal plane. The shapes of the light incident surface 11 and the light emitting surface 12 on the vertical plane will be described in detail below with reference to the sectional view of FIG. 7.

In the present example, along the rip cutting line of the light incident surface 11, a thickness between the light incident surface 11 and the light emitting surface 12 is in an increasing tendency along the rip cutting line of the light incident surface 11.

The cross sections of the light incident surface 11 and the light emitting surface 12 in the vertical direction are partial circles or ovals basically, and an upper edge of the cross section is a continuous arc basically. In the present example, the light incident surface 11 and the light emitting surface 12 are both symmetric in the four quadrants, the highest point of the light incident surface 11 is the center point of the light incident surface 11, and the highest point of the light emitting surface 12 is the center point of the light emitting surface 12.

In the present example, the light emitting unit 20 (referring to FIG. 3) is aligned with the center point of and the light emitting surface 12 in the vertical direction. In this situation, the light emitting unit 20 is located on the point of intersection of the light emitting rip cutting line 123 (referring to FIG. 6) with the light emitting cross cutting line 122 (referring to FIG. 6) of the light emitting surface 12.

It should be noted that in the examples of the present disclosure, "the light emitting unit 20 is aligned with the center point of the light emitting surface 12 in the vertical direction" does mean the absolute alignment mathematically, but a certain offset may occur between the light emitting unit 20 and the center point of the light emitting surface 12, and this offset distance between a center of the light emitting unit 20 and the center point of the light emitting surface 12 may be 20% of a width of the light emitting unit 20, the offset herein may be in any direction. For example, the offset may be an offset towards one side within a range of 0.55 mm.

In a case where the light distribution element 10 only covers one light emitting unit 20, only the size of the light emitting unit 20 is required to be determined. In a case where the light emitting unit 20 is moved along the direction of the cross cutting line, the size of the light emitting unit 20 in the direction of the cross cutting line is taken as its width. In a case where the light distribution element 10 covers a plurality of light emitting units 20, an overall size of these light emitting units 20 is to be obtained, which is not repeated herein.

Figure 8:
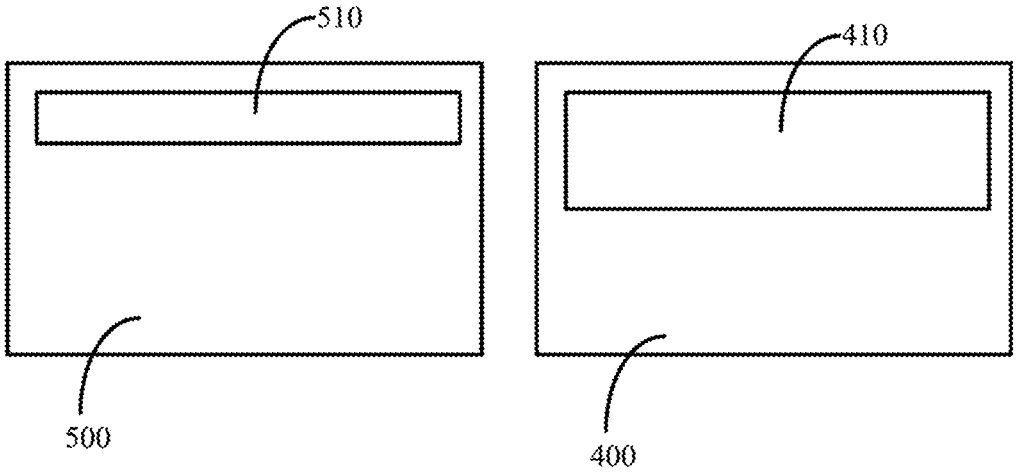
FIG. 8 is a schematic comparison diagram of a light spot formed by the light source module shown in FIG. 4 with a light spot formed by the light distribution element.

FIG. 8 is a schematic comparison diagram of a light spot formed by the light source module shown in FIG. 4 with a light spot formed by the light distribution element. Referring to FIG. 5, the light rays emitted from the light emitting unit 20 are processed by the light incident surface 11 and the light emitting surface 12, and then shift away from the center point of the light incident surface 11, that is to shift towards a portion of the light distribution element with a larger thickness, such that the light rays are diffused, thereby obtaining a light spot 400, and a width of an area of a yellow spot 410 in the light spot 400 is enlarged. Compared with the width of the yellow spot 510 in the light spot 500 of the light ray emitted from an ordinary light distribution element, the area of the yellow spot 410 formed by the light distribution element 10 is obviously larger, such that the concentration of the yellow light ray is reduced, thereby weakening the yellow spot.

In the examples of the present disclosure, in the light spot formed by an area of the light distribution element 10 with a larger thickness, a color tolerance between the yellow spot and white light is less than a preset color difference. The preset color tolerance may be set according to the reception capability or ethnic characteristics of the user in the application area of the lighting device 1000 (referring to FIG. 2), so as to ensure that the yellow spot formed in the area of the light distribution element 10 with a larger thickness is light enough within the acceptable range of the user. In practical applications, the preset color difference is 4.

Each example in the specification is described in a progressive manner. The same or similar parts in the examples are just references to each other. Every example illustrates in emphasis what is different from the other examples. In particular, for the apparatus example, because it is basically similar to the method example, the description is relatively simple, and for the relevant part, reference is just made to the part of the description of the method example.

Examples of the present disclosure provide a light distribution element, a light source module and a lighting device.

The examples of the present disclosure provide a light distribution element, comprising: a light incident surface, which is in a shape of a smooth inward concave curved surface and forms an accommodation cavity for accommodating a light emitting unit; and a light emitting surface, which is in a shape of a smooth outward convex curved surface and is opposite to the light incident surface. A thickness difference is between the light incident surface and the light emitting surface, and in a light spot formed by light emitted from the light emitting surface located on a portion with a larger thickness, a color tolerance between a yellow spot and white light is less than a preset color difference.

Preferably, the preset color difference is 4.

Preferably, an offset distance between a center of the light emitting unit and a center point of the light emitting surface is 20% of a width of the light emitting unit.

Preferably, an offset distance between a center of the light emitting unit and a center point of the light emitting surface is within a range of 0.55 mm.

Preferably, the light emitting surface comprises a center point, the center point of the light emitting surface is staggered with a center point of the light incident surface in a vertical direction.

The examples of the present disclosure provide a light distribution element, comprising: a light incident surface, which is in a shape of a smooth inward concave curved surface and forms an accommodation cavity for accommodating a light emitting unit, and comprises a center point; and a light emitting surface, which is in a shape of a smooth outward convex curved surface and is opposite to the light incident surface, and comprises a center point. The center point of the light emitting surface is staggered with the center point of the light incident surface in a vertical direction, and the center point of the light emitting surface is aligned with the light emitting unit located in the accommodation cavity in the vertical direction.

Preferably, the center point of the light incident surface is a highest point of the light incident surface, and the center point of the light emitting surface is a highest point of the light emitting surface.

Preferably, each of the light incident surface and the light emitting surface has a cross cutting line and a rip cutting line for dividing into four quadrants, and both the light incident surface and the light emitting surface are symmetric in the four quadrants.

Preferably, along the cross cutting line of the light emitting surface, a thickness between the light incident surface and the light emitting surface is characterized in that the thickness is minimum between the center point of the light emitting surface and the light incident surface, and from the center point to two sides of the light emitting surface, the thickness between the light emitting surface and the light incident surface increases symmetrically.

Preferably, along the rip cutting line of the light incident surface, a thickness between the light incident surface and the light emitting surface is in an increasing tendency.

Preferably, a projection of the cross cutting line of the light incident surface on a horizontal plane is shorter than a projection of the rip cutting line of the light incident surface on the horizontal plane.

Preferably, a projection of the cross cutting line of the light emitting surface on a horizontal plane is longer than a projection of the rip cutting line of the light emitting surface on the horizontal plane.

Preferably, a projection of the cross cutting line of the light incident surface on a horizontal plane is parallel to a projection of the cross cutting line of the light emitting surface on the horizontal plane.

Preferably, a distance between a projection of the rip cutting line of the light incident surface on a horizontal plane and a projection of the rip cutting line of the light emitting surface on the horizontal plane is less than a preset line distance threshold value.

Preferably, the projection of the rip cutting line of the light incident surface on the horizontal plane coincides with the projection of the rip cutting line of the light emitting surface on the horizontal plane.

Preferably, a ratio between a projection of the cross cutting line and a projection of the rip cutting line on a horizontal plane in the light incident surface is greater than a ratio between a projection of the cross cutting line and a projection of the rip cutting line on the horizontal plane of the light emitting surface.

Preferably, in projections on a horizontal plane, a point distance between a portion of an edge of the light incident surface and a portion of an edge of the light emitting surface is less than a preset point distance threshold value.

Preferably, in the projections of the light incident surface and the light emitting surface on the horizontal plane, at least a part of the edge of the light incident surface coincides with a part of the edge of the light emitting surface.

Preferably, the light distribution element comprises a bottom surface surrounding a peripheral side of the light incident surface and the bottom surface is flat.

Preferably, the light distribution element comprises a top surface surrounding a peripheral side of the light emitting surface, and the bottom surface and the top surface are disposed in parallel and are connected with each other by a side surface to form a mounting part.

The examples of the present disclosure provide a light source module, comprising: a substrate, a light emitting unit, provided on the substrate, and the above-mentioned light distribution element. The light distribution element is mounted to the substrate and covered on the light emitting unit, and the light emitting unit is located in the accommodation cavity of the light distribution element and is aligned with a center point of the light emitting surface in a vertical direction.

Preferably, the light source module comprises a plurality of light distribution elements and a plurality of light emitting units, the plurality of light emitting units are arranged on the substrate in an array, and at least one light emitting unit is provide within each of the plurality of light distribution elements.

Preferably, an offset direction of a center point of the light incident surface is identical to an offset direction of the center point of the light emitting surface in each light distribution element.

Preferably, a distance between the light distribution elements in a same row or a same column is same.

Preferably, the substrate comprises a lengthwise direction, the substrate comprises a light source accommodation region and a mounting region which are sequentially arranged along the lengthwise direction, and the light emitting unit is in the light source accommodation region.

The examples of the present disclosure provide a lighting device, comprising: a power source module, and at least one of the above mentioned light source modules. The light source module is electrically connected with the power source module.

Preferably, the lighting device is a street lamp.

Preferably, the lighting device further comprises a housing, and the power source module and the light source module are mounted to the housing; the lighting device further comprises a vertical supporting arm connected with the housing.

As can be seen from the technical solution provided by the examples of the present disclosure, in the light distribution element, the light source module and the lighting device provided by the examples of the present disclosure, the light incident surface and the light emitting surface of the light distribution element are both smooth curved surfaces and a thickness difference is between the light incident surface and the light emitting surface; in a light spot formed by light emitted from the light emitting surface located on a portion with a larger thickness, an area of a yellow spot is larger than a preset area. The concentration of the yellow light is decreased by presetting the size of the preset area, thereby weakening the yellow spot and ensuring the illumination effect of the lighting device.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

What are described above are only examples of the present disclosure, but are not intended to limit the protection scope of the present disclosure. Persons of ordinary skill in the art may make kinds of modifications to the present disclosure. Any modification, equivalent replacement, and improvement made within the spirit and principle of the present disclosure all fall within the protection scope of the present disclosure.

What is claimed is:

1. A light distribution element, comprising:

a light incident surface, which is in a shape of a smooth inward concave curved surface and forms an accommodation cavity for accommodating a light emitting unit; and a light emitting surface, which is in a shape of a smooth outward convex curved surface and is opposite to the light incident surface, wherein a thickness difference exists and is between the light incident surface and the light emitting surface, light rays emitted from a light emitting unit are processed by the light incident surface and the light emitting surface, and then shift towards a portion of the light distribution element with a larger thickness difference, such that the light rays are diffused and obtains a light spot, and wherein a third center point of the light emitting unit is aligned with a first center point of the light emitting surface in a vertical direction.

2. The light distribution element according to claim 1, wherein an offset distance between a center of the light emitting unit and a center point of the light emitting surface is 20% of a width of the light emitting unit.

3. The light distribution element according to claim 1, wherein an offset distance between a center of the light emitting unit and a center point of the light emitting surface is not greater than 0.55 mm.

4. The light distribution element according to claim 1, wherein the first center point of the light emitting surface is staggered with a second center point of the light incident surface in a vertical direction.

5. A light distribution element, comprising:

a light incident surface, which is in a shape of a smooth inward concave curved surface and forms an accommodation cavity for accommodating a light emitting unit, comprises a center point; and a light emitting surface, which is in a shape of a smooth outward convex curved surface and is opposite to the light incident surface, comprises a center point, wherein a first center point of the light emitting surface is staggered with a second center point of the light incident surface in a vertical direction, and the first center point of the light emitting surface is aligned with a third center point of the light emitting unit located in the accommodation cavity in the vertical direction.

6. The light distribution element according to claim 5, wherein the second center point of the light incident surface is a highest point of the light incident surface, and the first center point of the light emitting surface is a highest point of the light emitting surface.

7. The light distribution element according to claim 5, wherein each of the light incident surface and the light emitting surface has a cross cutting line and a rip cutting line for dividing them into four quadrants, and both the light incident surface and the light emitting surface are symmetric in the four quadrants.

8. The light distribution element according to claim 7, wherein along the cross cutting line of the light emitting surface, a thickness between the light incident surface and the light emitting surface exists and the thickness is minimum between the first center point of the light emitting surface and the second light incident surface, and from the first and second center point to two sides of the light emitting surface, the thickness between the light emitting surface and the light incident surface increases symmetrically.

9. The light distribution element according to claim 7, wherein along the rip cutting line of the light incident surface, a thickness between the light incident surface and the light emitting surface exists and is in an increasing tendency.

10. The light distribution element according to claim 7, wherein a projection of the cross cutting line of the light incident surface on a horizontal plane is shorter than a projection of the rip cutting line of the light incident surface on the horizontal plane.

11. The light distribution element according to claim 7, wherein a projection of the cross cutting line of the light emitting surface on a horizontal plane is longer than a projection of the rip cutting line of the light emitting surface on the horizontal plane.

12. The light distribution element according to claim 7, wherein a projection of the cross cutting line of the light incident surface on a horizontal plane is parallel to a projection of the cross cutting line of the light emitting surface on the horizontal plane.

13. The light distribution element according to claim 7, wherein a distance exists between a projection of the rip cutting line of the light incident surface on a horizontal plane and a projection of the rip cutting line of the light emitting surface on the horizontal plane and is less than a preset line distance threshold value.

14. The light distribution element according to claim 13, wherein the projection of the rip cutting line of the light incident surface on the horizontal plane coincides with the projection of the rip cutting line of the light emitting surface on the horizontal plane.

15. The light distribution element according to claim 7, wherein a ratio exists between a projection of the cross cutting line and a projection of the rip cutting line on a horizontal plane in the light incident surface and is greater than a ratio between a projection of the cross cutting line and a projection of the rip cutting line on the horizontal plane of the light emitting surface.

16. The light distribution element according to claim 5, wherein, in projections on a horizontal plane, a point distance exists between a portion of an edge of the light incident surface and a portion of an edge of the light emitting surface and is less than a preset point distance threshold value.

17. The light distribution element according to claim 16, wherein, in the projections of the light incident surface and the light emitting surface on the horizontal plane, at least a part of the edge of the light incident surface coincides with a part of the edge of the light emitting surface.

18. A light source module, comprising:

a substrate, a light emitting unit provided on the substrate, and a light distribution element, and wherein the light distribution element comprises:

a light incident surface, which is in a shape of a smooth inward concave curved surface and forms an accommodation cavity for accommodating a light emitting unit; and a light emitting surface, which is in a shape of a smooth outward convex curved surface and is opposite to the light incident surface, wherein a thickness difference exists and is between the light incident surface and the light emitting surface, light rays emitted from a light emitting unit are processed by the light incident surface and the light emitting surface, and then shift towards a portion of the light distribution element with a larger thickness difference, such that the light rays are diffused and obtains a light spot, and wherein the light distribution element is mounted to the substrate and covers the light emitting unit, and the light emitting unit is located in the accommodation cavity of the light distribution element and a third center point of the light emitting unit is aligned with a first center point of the light emitting surface in a vertical direction.

19. The light source module according to claim 18, wherein the light source module comprises a plurality of light distribution elements and a plurality of light emitting units, the plurality of light emitting units are arranged on the substrate in an array, and at least one light emitting unit is provide within each of the plurality of light distribution elements.

* * * * *